US010273613B2

(12) United States Patent
Schwarzberger

(10) Patent No.: US 10,273,613 B2
(45) Date of Patent: Apr. 30, 2019

(54) METHOD AND APPARATUS FOR TIMING

(71) Applicant: ABM International, Inc., The Woodlands, TX (US)

(72) Inventor: Neal A. Schwarzberger, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 317 days.

(21) Appl. No.: 15/254,568

(22) Filed: Sep. 1, 2016

(65) Prior Publication Data

US 2017/0058443 A1 Mar. 2, 2017

Related U.S. Application Data

(60) Provisional application No. 62/212,947, filed on Sep. 1, 2015.

(51) Int. Cl.

| | |
|---|---|
| ***D05B 19/14*** | (2006.01) |
| ***D05B 19/12*** | (2006.01) |
| ***D05B 57/30*** | (2006.01) |

(52) U.S. Cl.

CPC ..... *D05B 19/12* (2013.01); *D05B 19/14* (2013.01); *D05B 57/30* (2013.01)

(58) Field of Classification Search

CPC ..... D05C 11/04; D05B 19/12; D05B 19/14

USPC ..... 112/182, 101, 240, 245, 246

See application file for complete search history.

(56) References Cited

U.S. PATENT DOCUMENTS

| | | | | | |
|---|---|---|---|---|---|
| 3,618,547 | A * | 11/1971 | Howell | D05B 3/18 | 112/240 |
| 3,759,202 | A * | 9/1973 | Jean-Blanc | D05B 29/02 | 112/239 |
| 4,073,249 | A * | 2/1978 | Mulkey | D05B 27/04 | 112/317 |
| 4,292,907 | A * | 10/1981 | Gilbride | D05B 29/02 | 112/236 |
| 5,653,185 | A * | 8/1997 | Badillo | D05B 29/12 | 112/168 |

* cited by examiner

*Primary Examiner* — Tajash D Patel

(74) *Attorney, Agent, or Firm* — Timothy W. Menasco, Esq.; Harter Secrest & Emery LLP

(57) ABSTRACT

Presented is an apparatus and method for hook timing. An exemplary apparatus includes a frame, the frame having a top portion and a bottom portion, the top portion having a needle bar channel, and a spacer, the spacer moveable relative to the frame to overlay a portion of the top portion of the frame. The apparatus further including a clasping element connected to the frame and operable to change an effective diameter of a portion of the channel, and a bottom plate, the bottom plate connected to the bottom portion of the frame.

18 Claims, 7 Drawing Sheets

METHOD AND APPARATUS FOR TIMING

BACKGROUND OF THE INVENTION

Field of the Invention

Figure 1:
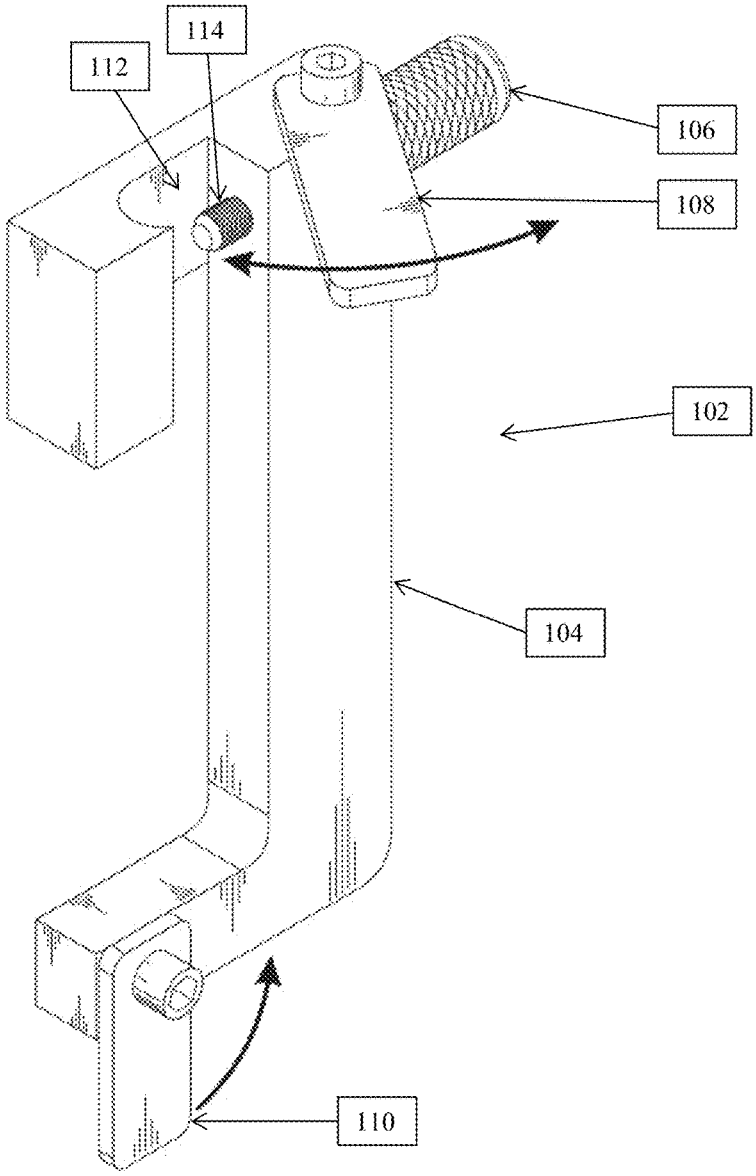

The present disclosure relates to a method and apparatus for timing. The present disclosure relates more specifically to a method and apparatus for hook timing.

Description of Related Art

Machine quilting is quilting made using a sewing machine to stitch in rows or patterns using select techniques to stitch through layers of fabric and batting in the manner of old-style hand-quilting.

Free motion quilting is a process used to stitch the layers of a quilt together using a domestic sewing machine. The operator controls the stitch length as well as the direction of the stitching line by moving the quilt with their hands. The stitching can be made in any direction to make straight or curved lines to create patterns. The length of each stitch is determined by the distance the quilt has been moved since the previous stitch.

One method of creating a stitch in a sewing or quilting machine includes the use of a rotary hook or rotating hook. The rotary hook continuously rotates in place, hooking the upper thread each time its pointed tip passes the position of the reciprocating needle. Enough upper thread is then pulled from above to pass around the bobbin case, which sites loosely inside the hook frame such that loops of thread can pass completely over it. The excess thread, no longer needed, is then pulled back upward by the sewing machine's take-up arm.

BRIEF SUMMARY OF THE INVENTION

In view of the foregoing, it is an object of the present disclosure to provide a method and apparatus for timing.

A first exemplary embodiment of the present disclosure provides an apparatus for timing. The apparatus includes a frame, the frame having a top portion and a bottom portion, the top portion having a needle bar channel, and a spacer, the spacer moveable relative to the frame to overlay a portion of the top portion of the frame. The apparatus further including a clasping element connected to the frame and operable to change an effective diameter of a portion of the channel, and a bottom plate, the bottom plate connected to the bottom portion of the frame.

A second exemplary embodiment of the present disclosure provides a method for timing. The method includes affixing a frame to a needle bar of a sewing head, the frame defining a needle bar channel and having a clasping element, a spacer, and a bottom plate, the needle bar channel cooperating with the clasping element operable to removeably affix the frame to the needle bar. The method further including positioning the needle bar with the affixed frame such that the bottom plate aligns with a needle point hook height, and rotating a hook point such that the hook point is in contact with the bottom plate.

A third exemplary embodiment of the present disclosure provides an apparatus for setting hook timing in a sewing machine having a needle bar and a hook. The apparatus includes a frame adapted to releasably mount relative to a sewing machine needle bar, and a needle height setting spacer movably connected to the frame between a spacing position and a retracted position. The apparatus further includes a hook angular displacement block connected to the frame to define an angular displacement fixing position.

The following will describe embodiments of the present disclosure, but it should be appreciated that the present disclosure is not limited to the described embodiments and various modifications of the disclosure are possible without departing from the basic principle. The scope of the present disclosure is therefore to be determined solely by the appended claims.

BRIEF DESCRIPTION OF THE SEVERAL VIEWS OF THE DRAWING(S)

FIG. 1 presents a perspective view of an exemplary device suitable for use in practicing exemplary embodiments of this disclosure.

Figure 2:
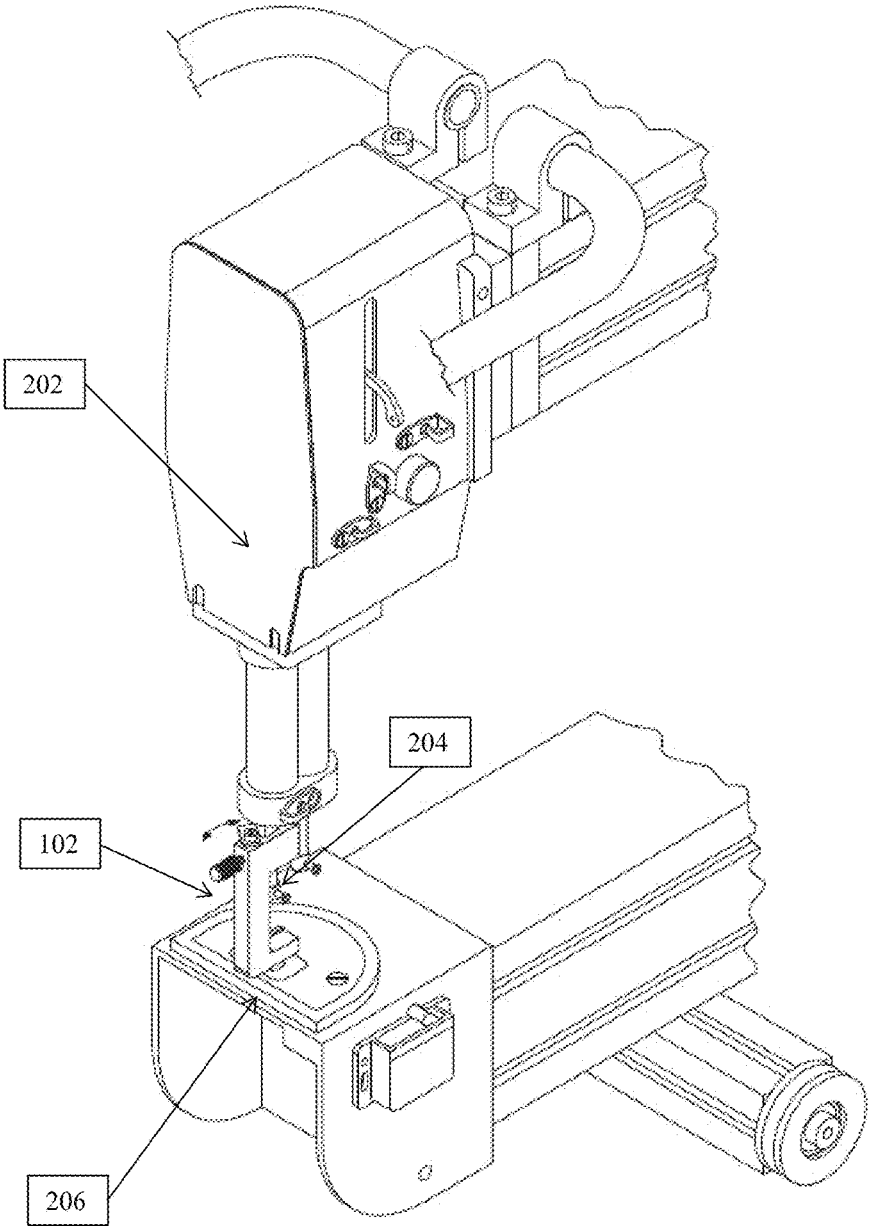

FIG. 2 presents a perspective view of an exemplary device and a sewing head for use in practicing exemplary embodiments of this disclosure.

Figure 3:
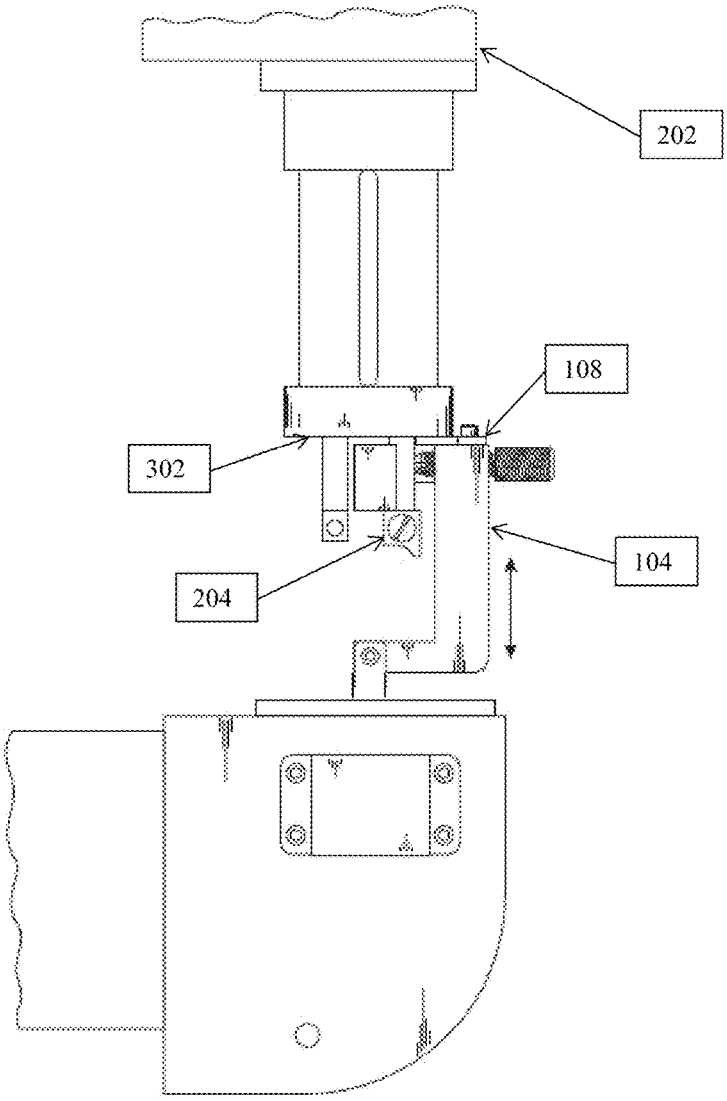

FIG. 3 presents a close-up view of an exemplary device and a sewing head for use in practicing exemplary embodiments of this disclosure.

FIGS. 4*a*, 4*b*, 4*c*, 4*d*, and 4*e* in combination present stages of an exemplary rotation cycle for a hook point and a reciprocating cycle of a reciprocating needle for stitching in a quilting or sewing machine.

Figure 5:
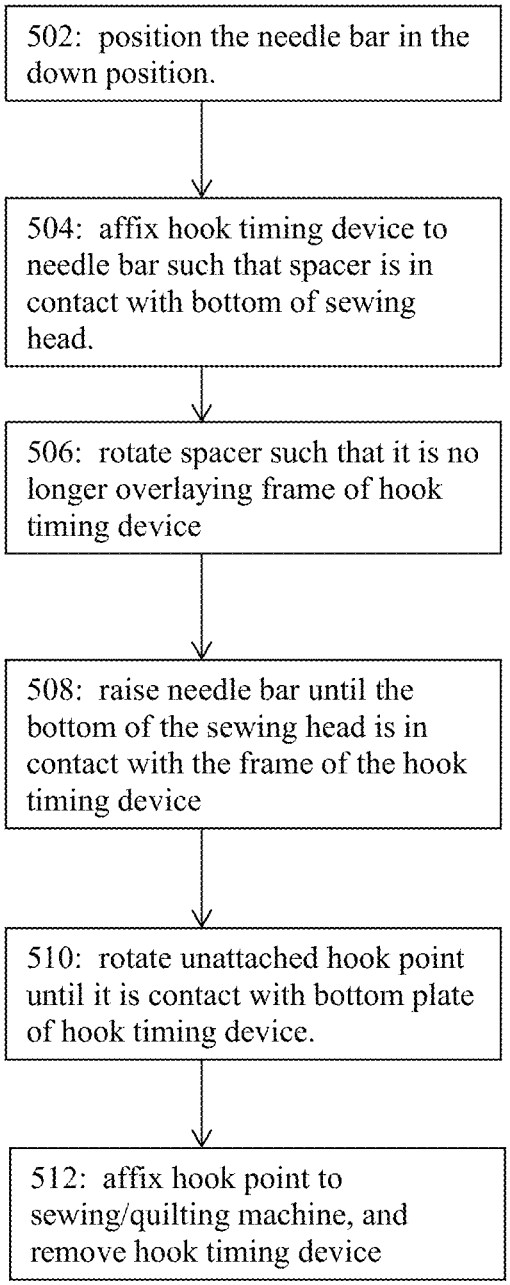

FIG. 5 presents an exemplary logic flow diagram in accordance with a method for practicing exemplary embodiments of this disclosure.

DETAILED DESCRIPTION OF THE INVENTION

Prior to quilting or sewing with a quilting machine or sewing machine it is often required that a user adjust the bobbin hook or hook point such that the cycle of its rotation during use aligns with the reciprocating cycle of the reciprocating needle of the sewing or quilting machine so that the hook point can properly grab thread from the reciprocating needle. In other words, the scarf of the reciprocating needle during the upward motion portion of the reciprocating needle cycle needs to align with the hook point such that the hook point can obtain or displace thread from the reciprocating needle.

The process for aligning the reciprocating needle scarf with the hook point is quite time consuming and cumbersome because users typically adjust the hook point manually by visually determining the distance between the reciprocating needle and the hook point to see when and where the hook point should be affixed to the sewing machine.

Accordingly, there is a need for a simpler more accurate mechanism to align the reciprocating needle with the hook point of a quilting or sewing machine such that the timing of the rotation cycle of the hook point is properly aligned with the reciprocating cycle of the reciprocating needle to allow for proper stitching.

Embodiments of the present disclosure provide an apparatus and method of using a device with a quilting or sewing machine such that a user can more easily and accurately align a reciprocating needle of a quilting or sewing machine with the hook point such that the user can properly operate the quilting or sewing machine.

Figure 4A:
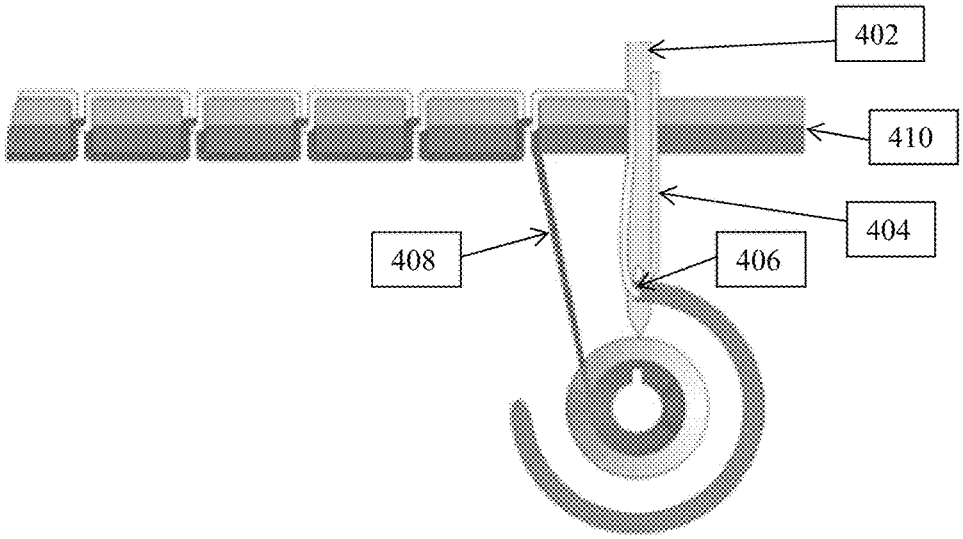

FIGS. 4*a*, 4*b*, 4*c*, 4*d*, and 4*e* in combination present stages of an exemplary rotation cycle for a hook point and a reciprocating cycle of a reciprocating needle for stitching in a quilting or sewing machine. In FIG. 4*a*, depicted is a reciprocating needle 402 with thread 404, a hook point 406 with thread 408, and a work piece 410. In FIG. 4*a* reciprocating needle 402 is not at the bottom of its reciprocating cycle, but has moved slightly above the bottom of its reciprocating cycle. Reciprocating needle 402 in FIG. 4*a* is moving upward in its reciprocating cycle. The hook point 406 is near the 12 o'clock position and is in contact with thread 404 and grapping thread 404 from reciprocating needle 402. The distance between the bottom of the reciprocating cycle of the reciprocating needle 402 and the point at which hook point 406 grabs or hooks thread 404 as shown in FIG. 4*a* will be referred to as the needle hook point height. The position of the hook point 406 in its rotation cycle at which it can grab thread 404 from reciprocating needle 402 will be referred to as hook timing.

Figure 4B:
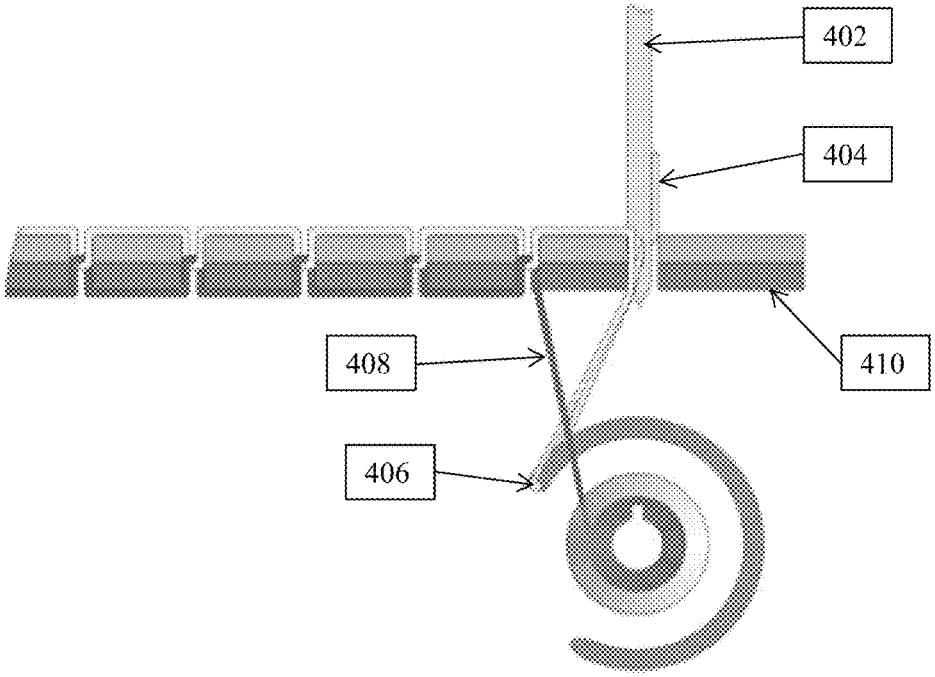

Turning to FIG. 4*b*, the reciprocating needle 402 has moved further in the upward portion of its reciprocating cycle partially through work piece 410. The hook point 406 has rotated towards the left in order to create a stitch between thread 404 and thread 408.

Figure 4C:
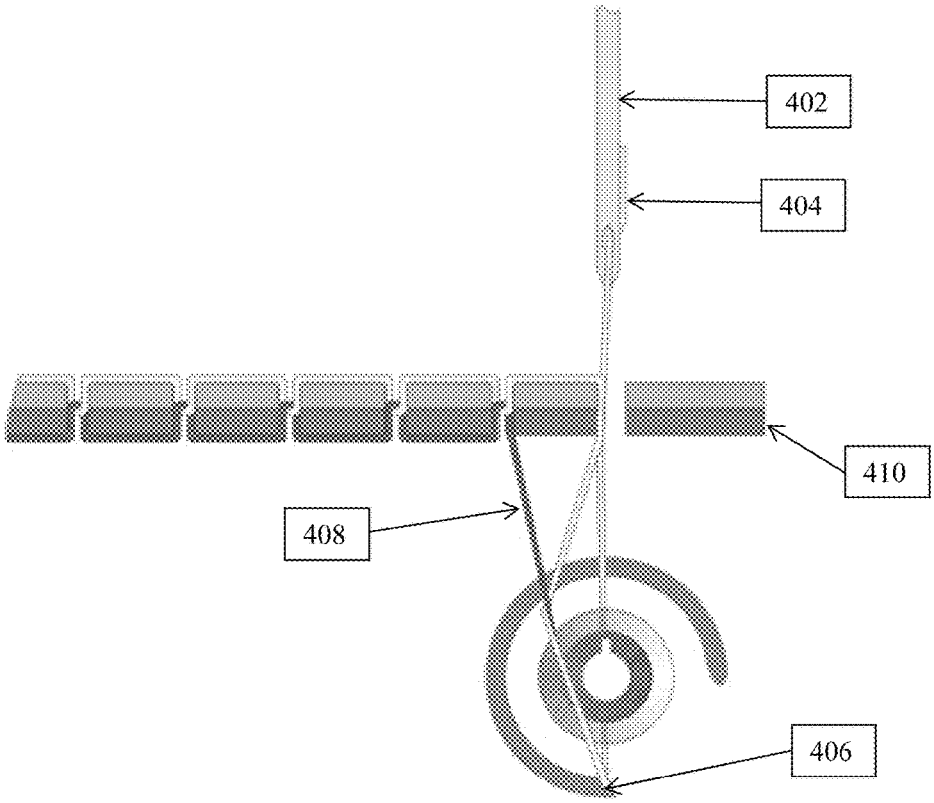

Referring to FIG. 4*c*, the reciprocating needle 402 is at the highest point of its reciprocating cycle and it is no longer in contact with work piece 410. The hook point 406 has also continued to rotate in a counter-clockwise fashion to complete the stitch and is located at the 6 o'clock position. It should be noted that embodiments of the present disclosure include a hook point 406 rotating in either a clockwise or counter-clockwise fashion.

Figure 4D:
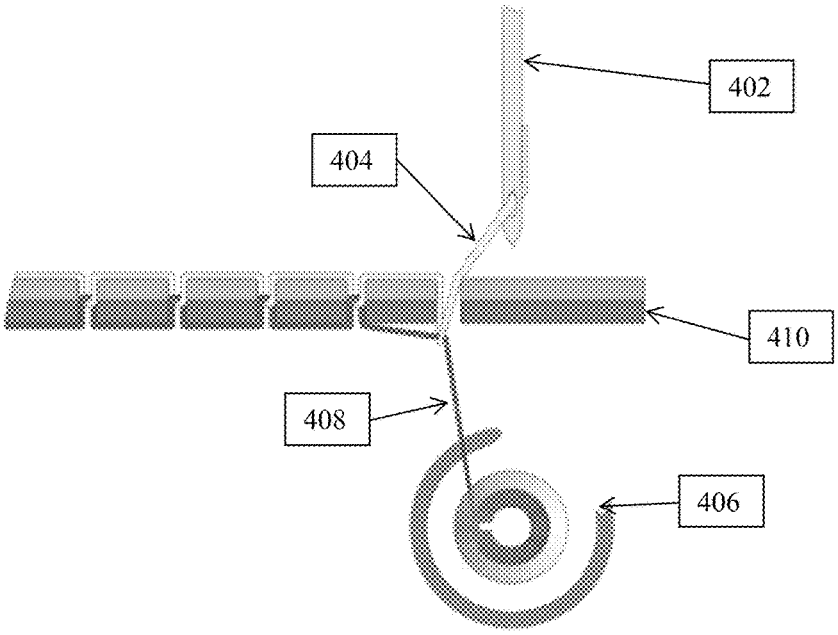

Reference is now made to FIG. 4*d*, shown is reciprocating needle 402 beginning its downward portion of its reciprocating cycle moving closer to work piece 410 and hook point 406. Hook point 406 has continued to rotate about its center now moving towards reciprocating needle 402.

Figure 4E:
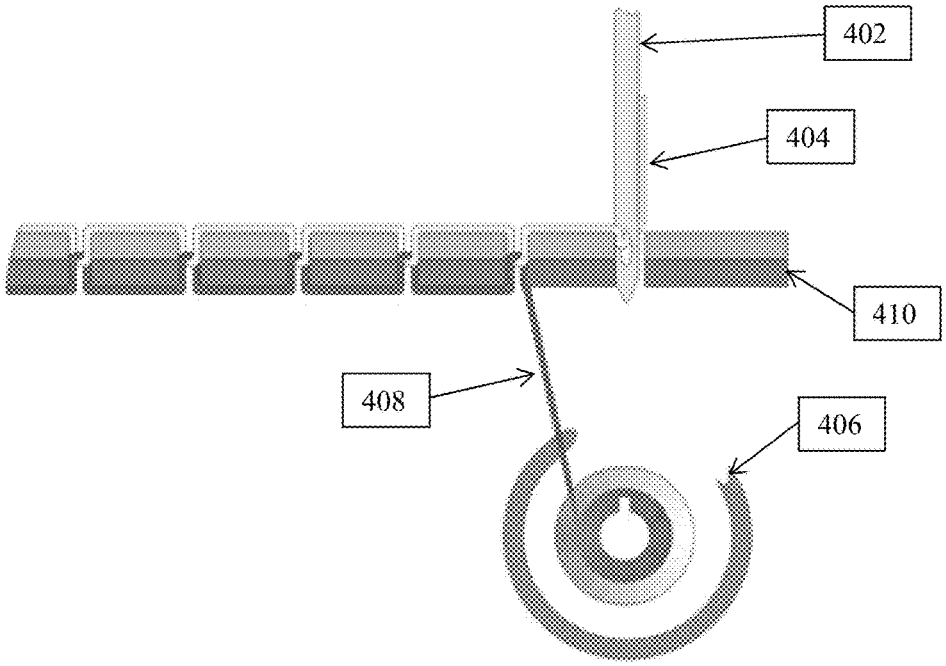

In FIG. 4*e*, reciprocating needle 402 has pierced work piece 410 and is continuing to move in a downward motion towards hook point 406. Hook point 406 has continued to rotate in a count-clockwise fashion towards reciprocating needle 402. Once reciprocating needle 402 has reached the bottom of its reciprocating cycle and begun it upward movement, hook point 406 will contact thread 404 maintained by reciprocating needle 402 as shown in FIG. 4*a* and the process or cycle for both the reciprocating needle 402 and hook point 406 will repeat.

Reference is now made to FIG. 1, which depicts a perspective view of an exemplary device suitable for use in practicing exemplary embodiments of this disclosure. Shown in FIG. 1 is device 102 for properly setting a hook point or hook timing on a quilting or sewing machine. Device 102 includes a frame 104, a clasping element 106, a spacer 108 (or needle height setting spacer), and a bottom plate 110 (or hook angular displacement block).

The frame 104 as depicted is U-shaped, however, embodiments of frame 104 also include C-shaped or V-shaped configurations. Frame 104 is rigid and can be made out of any type of metal, plastic, wood or composite that will provide a rigid structure. Frame 104 includes a channel or needle bar channel 112 spaced to fit a needle bar of a quilting or sewing machine.

Clasping element 106 is moveably affixed to frame 104. As shown in FIG. 1, clasping element 106 includes a screw 112 extending through frame 104, which when rotated by clasping element 106 can change an effective diameter of a portion of channel 112. Embodiments of clasping element 106 include any type of clamping, clasping, gripping, or attachment mechanism known in the art such that frame 104 through channel 112 can be removeably affixed to a needle bar of a quilting or sewing machine.

Spacer 108 is rotatably affixed to the top of frame 104 such that it can rotate into a position that overlays a portion of the top of frame 104 without covering channel 112. Spacer 108 can also rotate into a position that does not overlay a portion of the top of frame 104. Embodiments of spacer 108 have a thickness equal to the needle hook point height. It should be appreciated that the thickness of spacer 108 can vary between different types or brands of quilting or sewing machines due to the differences in needle hook point height for that particular brand, make or model.

Bottom plate 110 is affixed to the bottom of frame 104 such that its long axis is perpendicular to frame 104. Embodiments of bottom plate 110 in combination with frame 104 are sized such that when frame 104 is affixed at channel 112 with clasping element 106 to a needle bar of a quilting or sewing machine replicate or simulate the length and location of a reciprocating needle attached to the needle bar located at the needle hook point height. Embodiments of bottom plate 110 include bottom plate 110 being both fixedly attached to frame 104 or rotateably attached to frame 104. Embodiments of bottom plate 110 include the long sides of bottom plate 110 having multiple grooves for receiving or contacting a hook point.

Reference is now made to FIG. 2, which illustrates a perspective view of an exemplary device and a sewing head for use in practicing exemplary embodiments of this disclosure. Shown in FIG. 2 is device 102 and sewing head 202. Sewing head 202 includes a needle bar 204 for maintaining a reciprocating needle for stitching. However, as depicted in FIG. 2, needle bar 204 does not contain a reciprocating needle. Also, depicted in FIG. 2 is the bottom portion 206 of the sewing head for maintaining a hook point. Device 102 as depicted in FIG. 2, is removably attached to needle bar 204 through channel 112 and clasping element 106.

Referring to FIG. 3, shown is a close-up view of an exemplary device and a sewing head for use in practicing exemplary embodiments of this disclosure. Shown in FIG. 3 is sewing head 202 with needle bar 204 and device 102. As depicted in FIG. 3, device 102 is removably attached to needle bar 204 at channel 112 with clasping element 106. Also, shown in FIG. 3 is the bottom of sewing head 302. In FIG. 3, spacer 108 is in contact with bottom of sewing head 302.

Needle bar 204 is able to move up and down thereby controlling the reciprocating cycle of a reciprocating needle maintained by needle bar 204. Device 102 is able to move up and down with needle bar 204 when attached to needle bar 204.

Reference is now made to FIG. 5, which presents an exemplary process for using device 104 with a quilting or sewing machine to properly set or align the hook timing. The process begins at block 502 which states position a needle bar in the down position. Then at block 504 a hook timing device (e.g., device 102) is affixed to the needle bar such that the spacer is in contact with the bottom of the sewing head. Next at block 506, the process continues rotating the spacer such that it is no longer overlaying the frame of the hook timing device and the needle bar is free to move up.

Then at block 508 the process continues with raising the needle bar until the bottom of the sewing head is in contact with the frame of the hook timing device. At this point, the bottom plate of the hook timing device is aligned with the location of where a reciprocating needle would contact the hook point. Accordingly, the length of embodiments of hook timing device (e.g, device 102) is sized such that it is equal to the needle hook point height. Then at block 510, an unattached hook point is rotated until it comes into contact with the bottom plate of the hook timing device. Then at block 512, the hook point is affixed to the sewing/quilting machine and the hook point timing device is removed from the needle bar.

It is to be understood that any feature described in relation to any one embodiment may be used alone, or in combination with other features described, and may also be used alone, or in combination with one or more features of any other of the embodiments, or any combination of any other of the embodiments. The presently disclosed embodiments are therefore considered in all respects to be illustrative. Furthermore, equivalents and modifications not described above may also be employed without departing from the scope of this disclosure, which is defined in the accompanying claims.

The invention claimed is:

1. An apparatus comprising:

(a) a frame, the frame having a top portion and a bottom portion, the top portion having a needle bar channel;

(b) a spacer, the spacer moveable relative to the frame to overlay a portion of the top portion of the frame;

(c) a clasping element connected to the frame and operable to change an effective diameter of a portion the needle bar channel; and (d) a bottom plate, the bottom plate connected to the bottom portion of the frame, wherein the bottom plate is connected to the portion of the frame such that it is located at a hook timing of a sewing machine when the bottom plate is at a needle hook point height of the sewing machine.

2. The apparatus according to claim 1, wherein the needle bar channel and the clasping element are able to removeably attach the frame to a needle bar of a sewing head.

3. The apparatus according to claim 1, wherein the spacer has a thickness that corresponds to a distance between a needle down position and a needle hook point height.

4. The apparatus according to claim 1, wherein the frame is U-shaped.

5. The apparatus according to claim 1, wherein the bottom plate is connected to the bottom portion of the frame in a position simulating a hook timing.

6. The apparatus according to claim 1, wherein the bottom plate is connected to the bottom portion of the frame in a position simulating a position of a needle hook point height.

7. The apparatus according to claim 1, wherein the frame is operable to move with a needle bar when the clasping element affixes the frame to the needle bar.

8. A method comprising:

(a) affixing a frame to a needle bar of a sewing head, the frame defining a needle bar channel and having a clasping element, a spacer, and a bottom plate, the needle bar channel cooperating with the clasping element operable to removeably affix the frame to the needle bar;

(b) positioning the needle bar with the affixed frame with a needle point hook height, wherein the bottom plate is in a position of reciprocating needle coupled to the needle bar; and (c) rotating a hook point such that the hook point is in contact with the bottom plate.

9. The method according to claim 8, wherein the affixing comprises the needle bar being in a down position of its reciprocating cycle and the spacer is in a first position in contact with a bottom of the sewing head, wherein the spacer is movably connected to the frame between a first position overlying a portion of a top the frame and able to unobscured the top of the frame in a second position.

10. The method according to claim 9, wherein the positioning comprises the spacer being in the second position, and raising the needle bar with the affixed frame until the frame is in contact with the sewing head, wherein the bottom plate is in a needle hook point height and hook timing position.

11. The method according to claim 8, wherein the needle bar channel and the clasping element are able to repeatedly affix the frame to the needle bar.

12. The method according to claim 8, wherein the body is U-shaped.

13. The method according to claim 8, wherein the body is V-shaped.

14. The method according to claim 8, wherein the bottom plate is affixed to the bottom portion in a position simulating a needle hook point height and a hook timing.

15. An apparatus for setting hook timing in a sewing machine having a needle bar and a hook, the apparatus comprising:

(a) a frame adapted to releasably mount relative to a sewing machine needle bar;

(b) a needle height setting spacer movably connected to a top portion of the frame, the needle height setting spacer operable to move between a spacing position and a retracted position; and (c) a hook angular displacement block connected to a bottom portion of the frame to define an angular displacement fixing position.

16. The apparatus of claim 15, further comprising a clamp connected to the frame, the clamp releasably retaining the frame relative to the needle bar.

17. The apparatus according to claim 16, wherein the frame and the hook angular displacement block have a length equal to a needle hook point height.

18. The apparatus according to claim 17, wherein the frame with the clamp are operable to affix to a needle bar, wherein the hook angular displacement block is located at a hook timing when also located at a needle hook point height.

* * * * *